United States Patent [19]

McManus

[11] 4,189,883

[45] Feb. 26, 1980

[54] COMPOSITE SYSTEM FOR FLOOR FRAME MEMBERS

[76] Inventor: Ira J. McManus, 39 Lincoln Ave., Florham Park, N.J. 07940

[21] Appl. No.: 930,950

[22] Filed: Aug. 4, 1978

[51] Int. Cl.[2] ..... E04B 1/16

[52] U.S. Cl. ..... 52/250; 52/334

[58] Field of Search ..... 52/250, 334, 332, 333

[56] References Cited

U.S. PATENT DOCUMENTS

| | | | |
|---|---|---|---|
| 2,132,220 | 10/1938 | Powers | 52/334 |
| 3,392,499 | 7/1968 | McManus | 52/483 |
| 3,457,818 | 7/1969 | McManus | 83/599 |
| 3,527,007 | 9/1970 | McManus | 52/327 |
| 3,566,567 | 3/1971 | Watanabe | 52/250 |
| 3,624,980 | 12/1971 | McManus | 52/327 |
| 3,683,580 | 8/1972 | McManus | 52/334 |
| 3,728,835 | 4/1973 | McManus | 52/334 |
| 4,056,908 | 11/1977 | McManus | 52/334 |
| 4,115,971 | 9/1978 | Varga | 52/250 X |

*Primary Examiner*—Alfred C. Perham

*Attorney, Agent, or Firm*—James J. Cannon, Jr.; James J. Cannon

[57] ABSTRACT

An improved composite concrete and steel construction system for floor framing members using composite action open web steel joist and concrete slab construction, composite beams; unpunched corrugated decking and composite joists at columns only. All beams are composite and all joist ends are composite at the beams. Joists between the columns are standard open web joists. This composite system results in the columns having floor supporting members in both major directions that are composite with the poured in place concrete slab, thus providing superior bracing of the columns and direct duplication of the horizontal forces in the slab to the column through the supporting members. This design utilizes less composite joists, allows greater leeway in the spacing of the composite joist webbing and is economical. The floor slab will still act as a diaphram in both major directions due to the composite beams and the composite joists at the columns acting at right angles to one another.

4 Claims, 4 Drawing Figures

COMPOSITE SYSTEM FOR FLOOR FRAME MEMBERS

BACKGROUND OF THE INVENTION

1. Field of the Invention

This invention pertains to concrete slab and steel construction and is directed particularly a simplification in composite open web steel joist and wire mesh reinforced concrete slab construction to provide a more economical composite floor or roof structure in building construction as compared to prior art construction. In this invention the columns have floor supporting members in both major directions that are composite with the poured in place concrete slab.

2. Description of the Prior Art

The improvement in this application pertains specifically to an improvement and simplification in the composite concrete slab and steel joist construction disclosed in the inventor's copending U.S. patent application, Ser. No. 865,632, filed Dec. 29, 1977, and also disclosed in his prior U.S. Pat. Nos. 4,056,908; 3,728,835; 3,683,580; and 3,624,980. It also relates to other patents covering elements of a composite beam and joist floor system including U.S. Pat. Nos. 3,392,499; 3,457,818; 3,527,007 and copending application Ser. No. 491,696 now U.S. Pat. No. 3,967,642.

Specifically, the inventor has designed a composite system for floor framing members for use in multi-story buildings which produces a structurally superior and more economical floor system then previously available. In this system open web steel joists and the supporting beams of the steel frame are bonded to a two and one-half inch thick poured in place concrete slab to make all the structural floor members work together and act compositely with the concrete floor deck.

The unique design desclosed in the prior patents cited above accomplishes composite construction in the following way. Open web joists are fabricated with the apices of the webs projecting above the top chord of the joists. After the joists are welded to the beams, precut sheet metal pans are placed along the beam between the joist ends. These pans allow the subsequently poured in place concrete slab to rest on top of the supporting beam and completely encase the joist ends. The encased joist ends act as shear connectors between the beam and the concrete slab. Long sheets of prepunched corrugated centering are placed over the joist webs and locked in place with metal wedges. After the poured concrete hardens, all joists and beams become composite with the concrete slab.

Copending application Ser. No. 865,632 discloses the use of an open web steel truss in a composite system to replace a beam. It is not directly related to the present application, but the truss could be used with the improvement described herein.

U.S. Pat. Nos. 4,056,908 and 3,728,835 best describe and illustrate the composite construction system of the inventor. In the system of these patents, it has been assumed that all joists extending between the beams had to be of the composite construction described in U.S. Pat. No. 3,728,835. This construction, while having all the advantages described in that patent, requires that the corrugated sheet metal be prepunched along a center line of the sheet to match the selected joist spacing. This prepunching of the corrugated sheet metal has posed several problems in field use and the inventor has found it desirable to minimize the punching required in corrugated sheet metal. Furthermore, it is sometimes not necessary or even desirable to make all the joists in a floor composite with the poured in place slab. With the system of the present invention only the joists at the columns are composite, the remaining joists being composite at their ends only where they join the beams. This permits the use of standard, unpunched decking at less cost. The decking can be put in place more economically and the wedges previously used are not required for the non-composite joists. Additionally, the composite joists can be made with the webs at any convenient spacing since they do not have to match holes in the deck.

With the simplified composite system of the present invention, the floor will still act as a diaphram in both major directions due to the use of composite beams and composite joists at the columns acting at right angles to one another.

SUMMARY OF THE INVENTION

This invention pertains to improvements and a simplification in composite construction systems for floor framing members utilizing composite concrete slab and open web steel joist construction. In such systems open web steel joists and the supporting beams of the steel frame are bonded to a poured in place concrete slab to make all the structural floor members work together and act compositely with the concrete floor deck. Open web composite joists are fabricated with the webs projecting above the top chord of the joists. After the joists are welded to the beams, precut sheet metal pans are placed between the joist ends along the beams. These pans allow the subsequently poured in place concrete slab to rest on top of the supporting beam and completely encase the joist ends. The encased ends act as shear connectors between the beam and the concrete slab. Long sheets of prepunched corrugated centering are placed over the joist webs and locked in place with metal wedges. After the poured concrete hardens, all joists and beams become composite with the concrete slab. The joist becomes composite over its full length. Further composite action may be obtained by providing a continuous round rod secured to the apex of each joist web projection along the length of each joist and draping wire mesh over said rods to provide further reinforcement for the concrete slab.

In the present invention the techniques for obtaining the benefits of composite concrete slab and steel joist construction are simplified while retaining most of its advantages. The usual structure has a plurality of spaced apart vertical, weight bearing columns extending from floor to ceiling. A plurality of spaced apart, weight-bearing, horizontally-oriented parallel beams usually extend in a longitudinal direction between said columns. The beams are usually secured to said columns and usually provide the principal weight-bearing support for the floor or ceiling. Intermediate weight-bearing support for the floor or ceiling is provided by a plurality of spaced apart transverse joists which extend from beam to beam, and are secured at each end to said beams. At periodic intervals, the joists will extend from column to column.

In the system of the present invention, the joists extending from column to column are fully composite joists fabricated in accordance with the construction described in U.S. Pat. No. 3,728,835. A composite action open web steel joist and concrete slab interconnection is obtained in which the upper apex portions of the steel joist webbing protrude through the upper chord members of the joist and through aperatures provided in the sheet metal formwork placed over such joists prior to the pouring of the concrete slab, wereby said protruding apex portions will be encased within the slab to act as shear interconnection devices therein. Wedge members forced between such protruding joist apex portions and the sheet metal formwork serve to mechanically secure the joist and formwork together to prevent leakage of the poured concrete through the sheet metal formwork openings and to enhance the locking of the slab to the joist.

In the system of the present invention, the joists which do not extend from column to column, but only from beam to beam do not have to be and in fact are not composite joists.

However, all joists, whether composite or not, and whether joined at their ends to the beams or to the columns, have composite end connections as described in U.S. Pat. No. 3,683,580. The joist end connection provides a composite action between the supporting beam and a concrete slab when the bearing end of the joist is encased in the concrete slab whereby the encased joist end is employed as a shear connector. In forming this composite joist end connection to the beams, a plurality of downward sloping pans are utilized which are prefabricated to fit the joist spacing and which extend longitudinally along the beam between the spaced apart joists. The pans are inserted between the joist ends supported at their upper end by a continuous pan support rod and seating a flanged edge on said pan support rod. The pans are locked in place by bending a locking tab around the support rod with finger pressure. The pans alone are sufficient to seal against concrete leakage. The pans allow the concrete to haunch down on the beam, encasing the joist ends. The hardened concrete acts as the top flange of the composite beam.

Thus, the system of the present invention utilizes fully composite joists between columns, non-composite intermediate joists having composite end connections to the beams, and fully composite beams through the composite end connections for all joists. The use of non-composite intermediate joists permits the use of unpunched corrugated decking between the columns. The system is utilized where it is not necessary or desirable to make all the joists in a floor composite. With the system of the present invention, the columns have floor supporting members in both major directions that are composite with the poured in place concrete slab. This system offers superior bracing of the columns in both major directions and allows direct duplication of horizontal forces in the slab to the column through the supporting members. Bending in the columns due to wind load introduced horizontally to the floor system is better resisted by the composite slab, beam and joist. This system permits the use of unpunched decking between columns and results in both lower material costs and lower on-site labor costs. It also eliminates the use of wedges for the non-composite joists. It has an additional significant advantage in that the composite joists which are only small proportion of the total number of joists, can be made with the webs at any convenient spacing because the webs do not have to match holes in the decking.

With the system of the present invention, the floor slab will still act as a diaphram in both major directions due to the composite beams and the composite joists at the columns acting at right angles to one another.

As an additional feature, tape may be utilized to close off the space between the top chord angles of all joists to eliminate spillage of concrete.

DESCRIPTION OF THE PREFERRED EMBODIMENT

Figure 1:
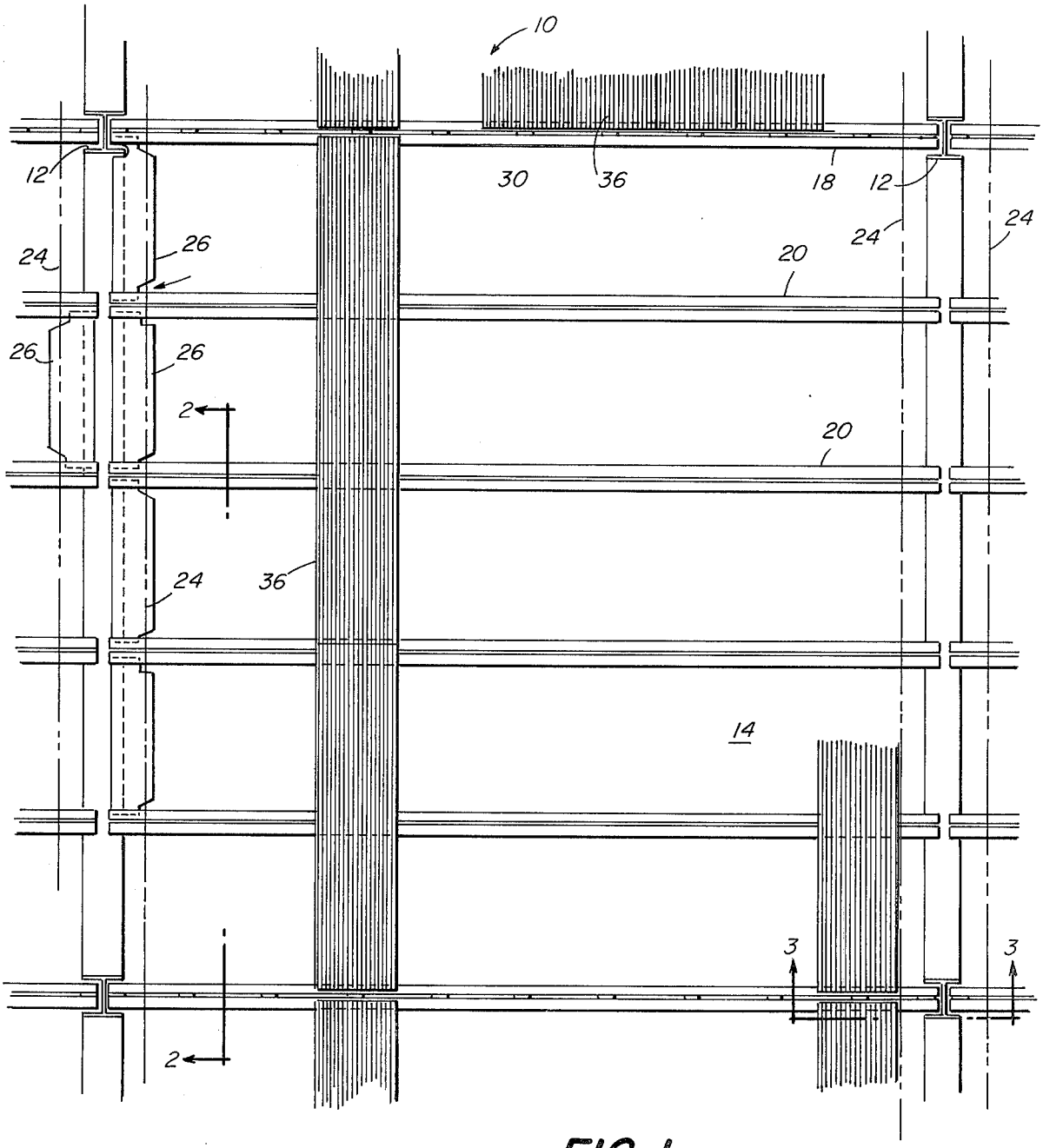
FIG. 1 is a plan view of the floor framing members of the system of the present invention.

Referring now to the drawings, and in particular to FIG. 1, there is shown a plan view of floor framing members of typical bay of a building illustrating the composite structural system 10 of this invention. A plurality of vertically oriented, spaced apart, weight bearing columns 12 define the corner perimeters of the bay section 14 used to describe system 10. A plurality of horizontally oriented, spaced apart, weight bearing beams 16 extend longitudinally across the underside of the floor and are secured to and supported by columns 12.

In system 10 fully composite joists 18 extend transversely between the columns 12, perpendicularly to the direction of the beams 16. These composite joists 18 are fabricated according to the techniques disclosed in U.S. Pat. No. 3,728,825, and will be discussed hereinafter with reference to FIG. 3. The intermediate spaced apart joists 20 which extend transversely from beam 12 to beam 12 but which do not connect to a column are referred to as non-composite joists 20. Non-composite joists 20, however, have a composite end connection 22 at their junctures with beams 16. These composite end connections 22 may be fabricated in a variety of ways as described in U.S. Pat. Nos. 3,728,825; 3,683,580 and others. In the system 10 of the present invention, since all composite joists 18 and non-composite joists 20 will have composite end connections 22, all beams 16 will be composite beams, as will be described hereinafter with reference to the Figures.

Referring still to FIG. 1, after beams 16 and joists 18 and 20 are placed in position, but before the pouring of concrete, unpunched continuous, corrugated decking 36 is spread over joists 20 from one composite joist 18 to the next composite joist 18 and from one beam 16 to the next beam 16, thus covering the area 14. The corrugated decking is spot welded to the tops of joists 18 and 20.

FIG. 1 also shows the continuous composite beam pan support angles or rods 24 and the composite beam pans 26 which are discussed with reference to FIG. 3. As indicated in FIG. 1, pans 26 must be cut to fit around columns 12.

Figure 2:
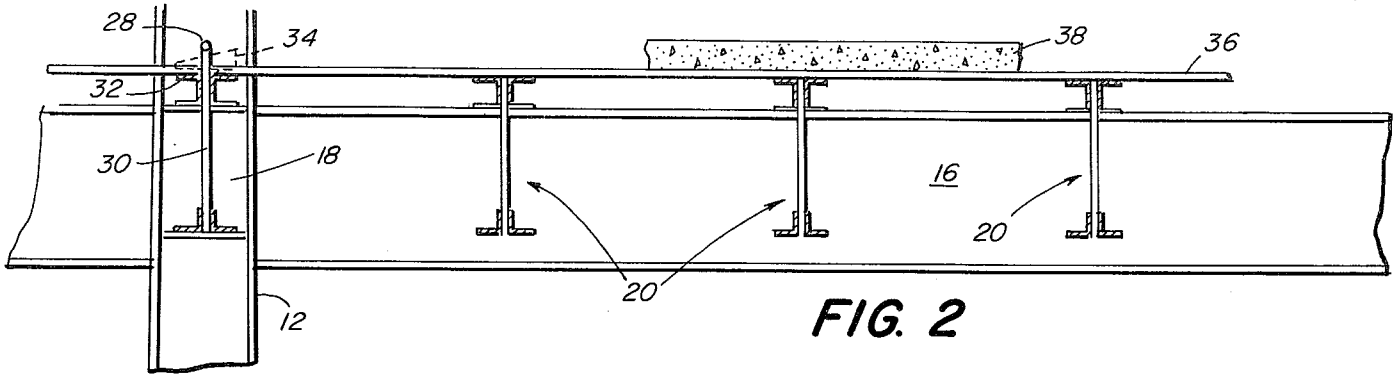
FIG. 2 is a cross-sectional view taken along the lines 2—2 of FIG. 1 showing a composite beam, a column, and composite and non-composite joists.

Referring now to FIG. 2, which is a cross-sectional view taken along the line 2—2 of FIG. 1, standard open web joists 20 are shown extending toward a compsite beam 16. At the left side a composite joist 18 is shown extending toward column 12. In the composite joist 18 the apex 28 of web 30 extends above its top chord 32 and is held in position by a wedge 34. A piece of continuous unpunched corrugated decking 36 extends over non-composite joists 20 and requires punching only where the apices 28 and webs 30 must protrude upwards in the composite joists 18. The composite joist 18 is field welded to the plates of column 12. The construction of composite joist 18 is fully disclosed in U.S. Pat. Nos. 3,728,835 and 4,056,908. A poured in place concrete slab 38 is poured over decking 36. When slab 38 hardens it becomes composite with joist 18, beam 16 and column 12 as described heretofor.

Figure 3:
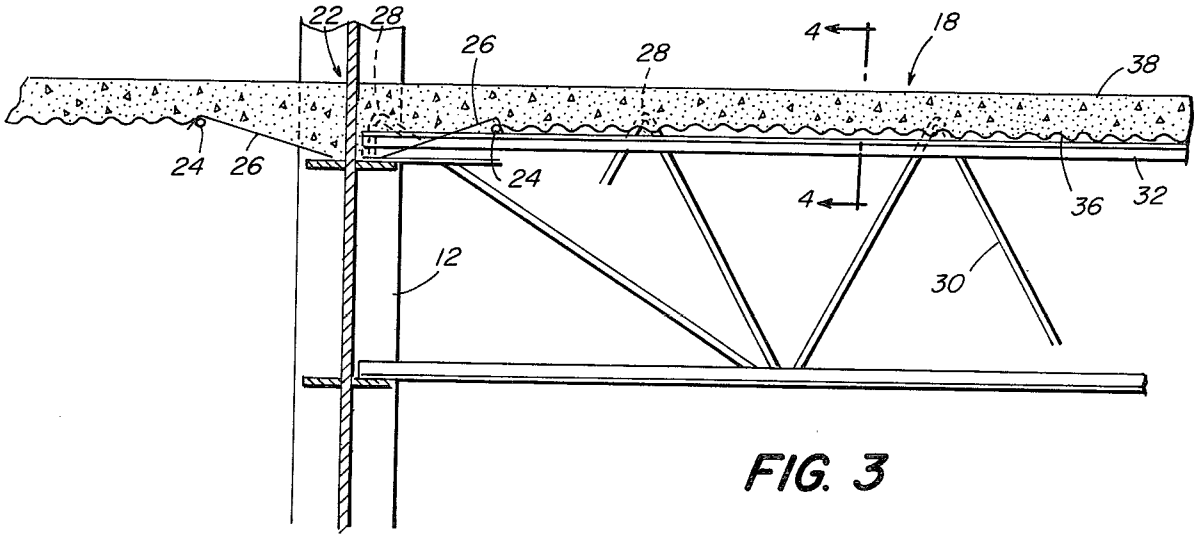
FIG. 3 is a cross-sectional view taken along the line 3—3 of FIG. 1 showing the composite end connection for a composite joist and a column.

Referring now to FIG. 3, which is a cross-sectional view taken along the line 3—3 of FIG. 1, showing the composite intersection 22 of a composite joist 18 with a column 12, this view is taken along the longitudinal axis of composite joist 18. This figure shows in cross-sectional view the apices 28 of webbing 30 of joist 18 protruding sufficiently above top chord 32 to pass through punched openings in corrugated decking 36 along the length of joist 18. The apex 28 of web 30 protrudes through top chord 32 so that it will be encased in the later poured in place concrete slab 38. The continuous pan support rod 24 is shown in place as is beam pan 26. The abutting adjacent composite joist 18 would have the same kind of composite inerconnection 22 with beam 26. Details of the composite joist construction are illustrated and described in the U.S. Patents cited above, especially U.S. Pat. No. 3,728,835.

An additional advantage to the infrequent use of composite joist 18 is that the spacing of the projecting web 30 may be random to suit construction needs on the site for for a particular building.

Figure 4:
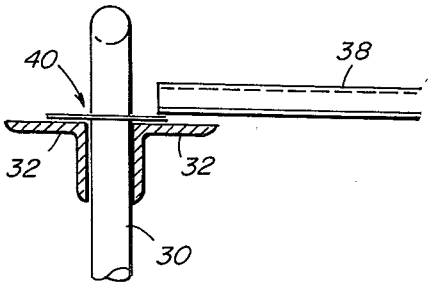
FIG. 4 is a cross-sectional view taken along the lines 4—4 of FIG. 1 showing the optional tape across the top chords of the joists.

FIG. 4 is a cross-sectional view taken along the line 4—4 of FIGS. 1 and 3 to illustrate the optional use of a tape 40 longitudinally extended to close the gap between the top chords of each joist 18, 20 to prevent any possible leakage of concrete that might seep under unpunched decking 36.

Thus, system 10 of this invention permits the use of unpunched corrugated decking 36 over area 14 with composite joists 18 extending only between columns 12. All beams 16 are composite because the interconnections 22 of all joists, composite 18 and non-composite 20, are composite. The continuous beam pan support rods 24 and the beam pans 26 extending between the joist ends allow the concrete slab 38 to haunch down to make the beams 16 composite.

The structural system 10 of floor framing members permits the columns 12 to have floor supporting members in both major directions that are composite with the poured in place concrete slab 38. System 10 offers superior bracing of the column 12 in both major directions and allows direct duplication of the horizontal forces in the slab 38 to the column 12 through the supporting members, composite beam 16 and composite joist 18. The columns 12 are better able to resist bending due to wind load introduced horizontally to the floor system due to the combined composite action of the slab 38, the composite beam 16 and the composite joist 18.

In the embodiment of system 10 presented herein standard unpunched decking is used over non-composite joists 20 to cover area 14, thus effecting a significant reduction in material costs and field installation costs. Wedges 34 are eliminated except at the columns 12. Additionally, the composite joists 18 can be made with their webbing 30 protruding above top chords 32 at any convenient spacing, since these joists 18 do not have to match prepunched holes in decking 36.

In system 10 the floor slab 30 will still act as a diaphram in both major directions due to the composite beams 16 and composite joists 18 at columns 12 acting at right angles to one another.

While I have illustrated and described herein a form in which my invention may be embodied in practice, it is to be understood that this form is presented by way of example only and not in a limited sense. The invention, in brief, includes all the modifications and embodiments coming within the scope and spirit of the following claims.

I claim:

1. An improved composite steel and concrete slab system for floor framing members comprising:
   - a plurality of spaced apart, weight bearing vertical columns;
   - a plurality of spaced apart, weight bearing horizontally oriented beams extending longitudinally between said columns;
   - a plurality of spaced apart, weight bearing composite-type joists extending transversely between said columns and secured thereto;
   - a plurality of intermediate, spaced apart, weight bearing non-composite-type joists extending transversely between said beams and secured thereto;
   - unpunched corrugated decking extending longitudinally from one composite-type joist to the next composite-type joist and extending laterally from one beam to the adjacent beam; thus covering an area defined by four columns at its perimeter;
   - a plurality of downward sloping beam pans secured to support rods positioned longitudinally along said beams and extending into the end positions of all of said joists such that poured in place concrete can flow down to said beams and haunch between the ends of abutting joists;
   - a concrete slab poured in place over said corrugated decking such that said composite-type joists become composite with said slab, said non-composite type joists have composite end connections with said slab, and said beams become composite with said slab.

2. The system of claim 1 wherein said composite-type joist further includes:
   - an open web steel joist;
   - the upper apices of the webbing of said joist protruding above the webbing of said joist protruding above the top chords of said joist;
   - aperatures in said concrete decking to permit said apices of said webbing to protrude therethrough;
   - wedge members to secure said apices above said corrugated decking;
   - the protruding apex portions of said webbing becoming incased in a poured in place concrete slab, acting as shear interconnection devices therein.

3. The system of claim 1 wherein said non-composite joist further includes:
   - a open web steel joist;
   - the upper apices of the last web at each end of said joist protruding above the ends of the top chord of said joist;
   - wedge members to secure said apices above the edges of said corrugated decking;
   - the protruding apex portions of said webbing at each of said joist becoming encased in the poured in place concrete slab over said beam;
   - said end apices acting as shear interconnecting devices where said joist meets said beam.

4. The system of claim 1 further including:
   - a tape extended longitudinally over said top chords of all of said joists to prevent the leakage of concrete therethrough.

* * * * *